US008960462B2

(12) United States Patent
He et al.

(10) Patent No.: US 8,960,462 B2
(45) Date of Patent: Feb. 24, 2015

(54) CONTROLLING METHOD, SYSTEM AND DEVICE FOR HOOK DEVIATION

(75) Inventors: Jinge He, Hunan (CN); Lianxi Deng, Hunan (CN); Sui Yan, Hunan (CN)

(73) Assignees: Hunan Sany Intelligent Control Equipment Co., Ltd. (CN); Sany Automobile Manufacture Co., Ltd. (CN)

( * ) Notice: Subject to any disclaimer, the term of this patent is extended or adjusted under 35 U.S.C. 154(b) by 473 days.

(21) Appl. No.: 13/380,570

(22) PCT Filed: Jun. 23, 2010

(86) PCT No.: PCT/CN2010/074325

§ 371 (c)(1), (2), (4) Date: Dec. 23, 2011

(87) PCT Pub. No.: WO2011/023029

PCT Pub. Date: Mar. 3, 2011

(65) Prior Publication Data

US 2012/0132604 A1 May 31, 2012

(30) Foreign Application Priority Data

Aug. 27, 2009 (CN) ..... 2009 1 0171349

(51) Int. Cl.

*B66C 13/06* (2006.01)
*B66C 23/88* (2006.01)
*B66C 13/08* (2006.01)

(52) U.S. Cl.

CPC ..... *B66C 23/88* (2013.01); *B66C 13/085* (2013.01)
USPC ..... 212/273

(58) Field of Classification Search

USPC ..... 212/272, 273, 256
See application file for complete search history.

(56) References Cited

U.S. PATENT DOCUMENTS 3,254,775 A * 6/1966 Bevard et al. ..... 212/273
3,365,076 A * 1/1968 McManus ..... 212/273

(Continued)

FOREIGN PATENT DOCUMENTS

CN 1152290 A 6/1997
CN 1433375 A 7/2003

(Continued)

OTHER PUBLICATIONS

Extended European Search Report for Application No./Patent No. 10811189.9-1705/2436640, dated Apr. 23, 2013.

(Continued)

*Primary Examiner* — Emmanuel M Marcelo
(74) *Attorney, Agent, or Firm* — Cantor Colburn LLP

(57) ABSTRACT

A controlling method for a hook deviation to regulate the deviation angle of a telescopic crane hook, involves following steps: A. Detecting the deviation angle and deviation direction of a rope, which is linked to the hook, in the horizontal plane relative to the direction of gravitational force; B. Judging whether the deviation angle is more than the predetermined value, if the deviation angle is more than the predetermined value, then turning to step C, and if the deviation angle is less than the predetermined value, then turning to step A; C. Compensatively controlling the deviation angle of the hook according to the deviation angle and direction. And a controlling system for the hook deviation and a controlling device for the hook deviation are provided. The method or system or device enables the detection of the deviation angle and direction of the hook in a quick and precise manner, and the compensatory control of the deviation angle of the hook is performed according to the detected deviation angle and direction, thus it avoids overdependence on human factor and reduces potential safety risks.

10 Claims, 4 Drawing Sheets

(56) References Cited

U.S. PATENT DOCUMENTS

| | | | | |
|---|---|---|---|---|
| 5,908,122 | A | 6/1999 | Robinett et al. | |
| 5,938,052 | A | 8/1999 | Miyano et al. | |
| 6,039,193 | A | 3/2000 | Naud et al. | |
| 8,235,229 | B2 * | 8/2012 | Singhose et al. | 212/275 |
| 2004/0164041 | A1 * | 8/2004 | Sawodny et al. | 212/273 |
| 2009/0008351 | A1 | 1/2009 | Schneider et al. | |
| 2011/0163057 | A1 * | 7/2011 | Bjorshol et al. | 212/272 |

FOREIGN PATENT DOCUMENTS

| | | | |
|---|---|---|---|
| CN | 1505590 | A | 6/2004 |
| CN | 1986374 | A | 6/2007 |
| CN | 101157359 | A | 4/2008 |
| CN | 201165455 | Y | 12/2008 |
| CN | 101428740 | A | 5/2009 |
| CN | 101659379 | A | 3/2010 |
| EP | 1661844 | A1 | 5/2006 |
| JP | 4-223993 | A | 8/1992 |
| JP | 7-144883 | A | 6/1995 |
| JP | 11-209065 | A | 8/1999 |
| JP | 2001-261283 | A | 9/2001 |

OTHER PUBLICATIONS

International Search Report for International Application No. PCT/CN2010/074325 mailed Sep. 23, 2010 with English translation.

* cited by examiner

CONTROLLING METHOD, SYSTEM AND DEVICE FOR HOOK DEVIATION

CROSS REFERENCE TO RELATED APPLICATIONS

This application is the national phase of International Application No. PCT/CN2010/074325, titled "CONTROLLING METHOD, SYSTEM AND DEVICE FOR HOOK DEVIATION", filed on Jun. 23, 2010, which claims the benefit of priority to Chinese Patent Application No. 200910171349.0 titled "CONTROLLING METHOD, SYSTEM AND DEVICE FOR HOOK DEVIATION", filed with the Chinese State Intellectual Property Office on Aug. 27, 2009, the entire disclosures of which are incorporated herein by reference.

FIELD OF THE INVENTION

The present application relates to a technical field of crane, and specifically relates to a method for controlling hook swing, a system for controlling hook swing and an apparatus for controlling hook swing, to regulate a swing angle of the hook during operation of a telescopic boom type crane.

BACKGROUND OF THE INVENTION

A telescopic boom type crane is a kind of commonly used hoisting equipment. A truck crane and an all terrain crane are both familiar telescopic boom type cranes. The telescopic boom type crane has such advantageous as good trafficability, good mobility, rapid traveling speed and fast transfer, and thus is more and more widely used in various constructions.

The telescopic boom type crane generally has a telescopic crane boom, a rotary table which can rotate in a horizontal plane, a cable, a windlass, a winding motor, a derricking cylinder and so on. The rotary table is driven by a rotary motor, and a fixed end of the crane boom is fixedly connected at the rotary table. The cable, with a fixed end thereof winded around the windlass and a free end thereof provided with a hook for hoisting goods, is provided along the crane boom. The winding motor can drive the windlass to rotate, and a forward rotation and a reversed rotation of the windlass can control the cable to be tightened and loosened. The crane boom is provided at a base portion thereof with the derricking cylinder, and stretch and retraction of the derricking cylinder can regulate an elevation angle of the crane boom. When it is needed to hoist the goods, the telescopic boom type crane is operated to stretch its crane boom, rotate the rotary table and control the windlass, such that the hook at the free end of the cable is aligned with and hook the goods, then the cable is tightened, the derricking cylinder is regulated, and the rotary table is rotated, such that the goods can be hoisted to a desired position.

During the hoisting process of the telescopic boom type crane, the hook usually swings, thus it is difficult to achieve some hoisting and lowering operations which require high accuracy. If the hook swings seriously, it would threaten personnel safety and property safety.

The hook swings in various forms under different operating conditions, and the swing of the hook mainly includes a longitudinal swing, a transverse swing and a complex swing. The longitudinal swing means that the hook swings forwardly and backwardly in a plane which consists of the crane boom and a projection of the crane boom in a horizontal plane. As shown in FIG. 1, during hoisting or lowering of goods, the goods are not hoisted or lowered vertically because of visual error of the operator or bending deformation of the crane boom, and thus the hook and the goods swing in the longitudinal direction. The transverse swing mainly means that the hook swings in a left direction and a right direction of the crane boom. As shown in FIG. 2, when the telescopic boom type crane is operated to rotate, the hook swings in the left direction and the right direction of the crane boom due to incorrect setting of an actuating acceleration or a stopping acceleration. The complex swing means that the hook swings both in the longitudinal direction and the transverse direction which is resulted from various operating conditions and operations. Whichever kind of swing would jeopardize safe and accurate hoisting and lowering of the telescopic boom type crane.

At present, for some high standard and high accuracy hoisting and lowering operations, it mainly depends on the experienced operator to operate the telescopic boom type crane cautiously and carefully, which process faces potential safety hazard due to relying too much on human factors during operation of the crane.

SUMMARY OF THE INVENTION

A first object of the present application is to provide a method for controlling hook swing, which can regulate a swing angle of a hook of a telescopic boom type crane rapidly and accurately, a second object of the present application is to provide a system for controlling hook swing, and a third object of the present application is to provide an apparatus for controlling hook swing.

In order to achieve the first object mentioned above, the present application provides a method for controlling hook swing to regulate a swing angle of the hook of the telescopic boom type crane, the method includes the following steps of:

A. detecting a swing angle and a swing direction of a cable, which is connected with the hook, in a horizontal plane with respect to a gravitational direction;

B. determining whether the swing angle is larger than a predetermined value, step B proceeding to step C if the swing angle is larger than the predetermined value, and step B proceeding to step A if the swing angle is smaller than the predetermined value;

C. performing a compensation control to the swing angle of the hook based on the swing angle and the swing direction.

Preferably, the swing angle is a longitudinal swing angle.

Preferably, the step of performing a compensation control to the swing angle of the hook based on the swing angle and the swing direction includes regulating an elevation angle of a crane boom, increasing the elevation angle of the crane boom if the swing direction is positive, and reducing the elevation angle of the crane boom if the swing direction is negative.

Preferably, the step of performing a compensation control to the swing angle of the hook based on the swing angle and the swing direction includes loosening the cable if the swing direction is positive and tightening the cable if the swing direction is negative.

Preferably, the swing angle is a transverse swing angle.

Preferably, the step of performing a compensation control to the swing angle of the hook based on the swing angle and the swing direction includes rotating a rotary table in the swing direction.

The method for controlling hook swing according to the present application includes the following steps of: A. detecting a swing angle and a swing direction of a cable, which is connected with the hook, in a horizontal plane with respect to a gravitational direction; B. comparing the detected swing angle with a predetermined value, step B proceeding to step C if the swing angle is larger than the predetermined value, and step B proceeding to step A if the swing angle is smaller than the predetermined value; and C. performing a compensation control to the swing angle of the hook based on the swing angle and the swing direction. The method for controlling hook swing according to the present application uses a method in which a swing angle and a swing direction of the cable in a horizontal plane are detected, to detect the swing angle of the hook, and compare the detected swing angle value with a predetermined standard value to determine whether the swing angle of the hook falls within a normal error range, and accordingly perform the compensation control to the swing angle of the hook compensatively based on the detected swing angle and swing direction if the swing angle of the hook is beyond the predetermined standard value, such that the swing angle of the hook falls within normal error range.

This kind of method for controlling hook swing can detect the swing angle and the swing direction of the hook rapidly and accurately, and can perform the compensation control to the swing angle of the hook based on the detected swing angle and swing direction, and thus can avoid the situation that an operator subjectively regulates the swing angle of the hook according to his perception and experience, which reduces potential safety hazard due to relying too much on human factors during the hoisting and lowering operations. With this kind of method for controlling hook swing, some hoisting and lowering operations that need high standard and high accuracy can be achieved, and safety and intelligent degree of operation of the telescopic boom type crane itself are enhanced.

In order to achieve the second object mentioned above, the present application provides a system for controlling hook swing which includes: a detecting unit, configured to detect a swing angle and a swing direction of a cable, which is connected with a hook, in a horizontal plane with respect to a gravitational direction, and to transmit a swing angle signal and a swing direction signal; a control unit, configured to receive the swing angle signal and the swing direction signal and determine whether the swing angle is larger than a predetermined value, and to transmit a control signal if the swing angle is larger than the predetermined value; a regulating unit, configured to receive the control signal to perform a compensation control to the swing angle of the hook. The control unit employs the method for controlling hook swing mentioned above as a control strategy, thus the system for controlling hook swing which employs the method for controlling hook swing as the control strategy has corresponding advantageous effects that the method for controlling hook swing has.

Preferably, the regulating unit may include:

a rotary table regulating unit configured to regulate a rotary direction and a rotary speed of the rotary table;

a cable regulating unit configured to regulate tightening and loosening of the cable; and a crane boom regulating unit configured to regulate an elevation angle of the crane boom.

Preferably, the system for controlling hook swing further includes a rotary speed measuring unit for a rotary table which is configured to measure a rotary speed of the rotary table and transmit a rotary speed signal, and the control unit is further configured to receive the rotary speed signal and determine whether the measured rotary speed is larger than a predetermined rotary speed, and to control the rotary speed of the rotary table to be smaller than the predetermined rotary speed if the measured rotary speed is larger than the predetermined rotary speed.

Preferably, the system for controlling hook swing further includes a rotary acceleration measuring unit for the rotary table which is configured to measure a rotary acceleration of the rotary table and to transmit a rotary acceleration signal, and the control unit is further configured to receive the rotary acceleration signal and determine whether the measured rotary acceleration is larger than a predetermined rotary acceleration, and to control the rotary acceleration of the rotary table to be smaller than the predetermined rotary acceleration if the measured rotary acceleration is larger than the predetermined rotary acceleration.

In order to achieve the third object of mentioned above, the present application provides an apparatus for controlling hook swing which includes a swing angle detecting device, a controller, a derricking regulating valve for controlling a derricking cylinder and a rotary motor. The swing angle detecting device is provided on a cable at a boom head of a crane boom, and a swing angle signal and swing direction signal output terminals of the swing angle detecting device are connected with a swing angle signal and swing direction signal receiving terminals of the controller, and control terminals of the controller are connected respectively with a control terminal of the derricking regulating valve and a control terminal of the rotary motor.

Preferably, the apparatus for controlling hook swing further includes a winding motor configured to drive the rotary table to rotate and a winding control electromagnetic valve configured to control a rotary direction and a rotary speed of the winding motor, and a control terminal of the winding control electromagnetic valve is connected with a control terminal of the controller.

Preferably, the apparatus for controlling hook swing further includes a rotary speed sensor provided on the rotary table of the telescopic boom type crane, and a rotary speed signal output terminal of the rotary speed sensor is connected with a rotary speed signal input terminal of the controller.

Preferably, the apparatus for controlling hook swing further includes a rotary acceleration sensor provided on the rotary table of the telescopic boom type crane, and a rotary acceleration signal output terminal of the rotary acceleration sensor is connected with a rotary acceleration signal input terminal of the controller.

Preferably, the swing angle detecting device for a cable is a dual inclination sensor.

The swing angle detecting device can detect a swing angle and a swing direction of a cable connected with a hook, and can transmit a detected swing angle signal and a detected swing direction signal to the controller. The controller receives the swing angle signal and the swing direction signal to determine whether the detected swing angle is larger than a predetermined value, and controls the derricking regulating valve and the rotary motor to perform corresponding actions if the swing angle is larger than the predetermined value, so as to achieve the compensation control to the swing angle of the hook.

This kind of apparatus for controlling hook swing can detect the swing angle and the swing direction of the hook rapidly and accurately, and can perform compensation control to the swing angle of the hook based on the detected swing angle and swing direction, and thus can avoid the situation that an operator subjectively regulates the swing angle of the hook according to his perception and experience, which reduces potential safety hazard due to relying too much on human factors during the hoisting and lowering operations. With this kind of apparatus for controlling hook swing, some hoisting and lowering operations that need high standard and high accuracy can be achieved, and safety and intelligent degree of the operation of the telescopic boom type crane itself are enhanced.

Wherein, in FIGS. 1 to 6:

| | |
|---|---|
| 1 swing angle detecting device for a cable | 2 controller |
| 3 rotary acceleration sensor | 4 rotary speed sensor |
| 5 derricking regulating valve | 6 winding motor |
| 7 winding control electromagnetic valve | 8 rotary motor |
| 9 goods | |

DETAILED DESCRIPTION

A first spirit of the present application is to provide a method for controlling hook swing, which can regulate a swing angle of a hook of a telescopic boom type crane rapidly and accurately. A second spirit of the present application is to provide a system for controlling hook swing. A third spirit of the present application is to provide an apparatus for controlling hook swing.

The present application is described hereinafter in conjunction with the drawings, the following description is only illustrative and explanative, and should not be interpreted as a limit to the protection scope of the present application.

The method for controlling hook swing according to the present application is configured to regulate the swing angle of the hook of the telescopic boom type crane. The method for controlling hook swing can regulate a longitudinal swing, a transverse swing, and a complex swing of the hook and will be explained through the following embodiments.

Firstly, the method for controlling hook swing according to the present application will be described by taking the case in which the longitudinal swing of the hook of the telescopic boom type crane is regulated as an example.

Figure 3:
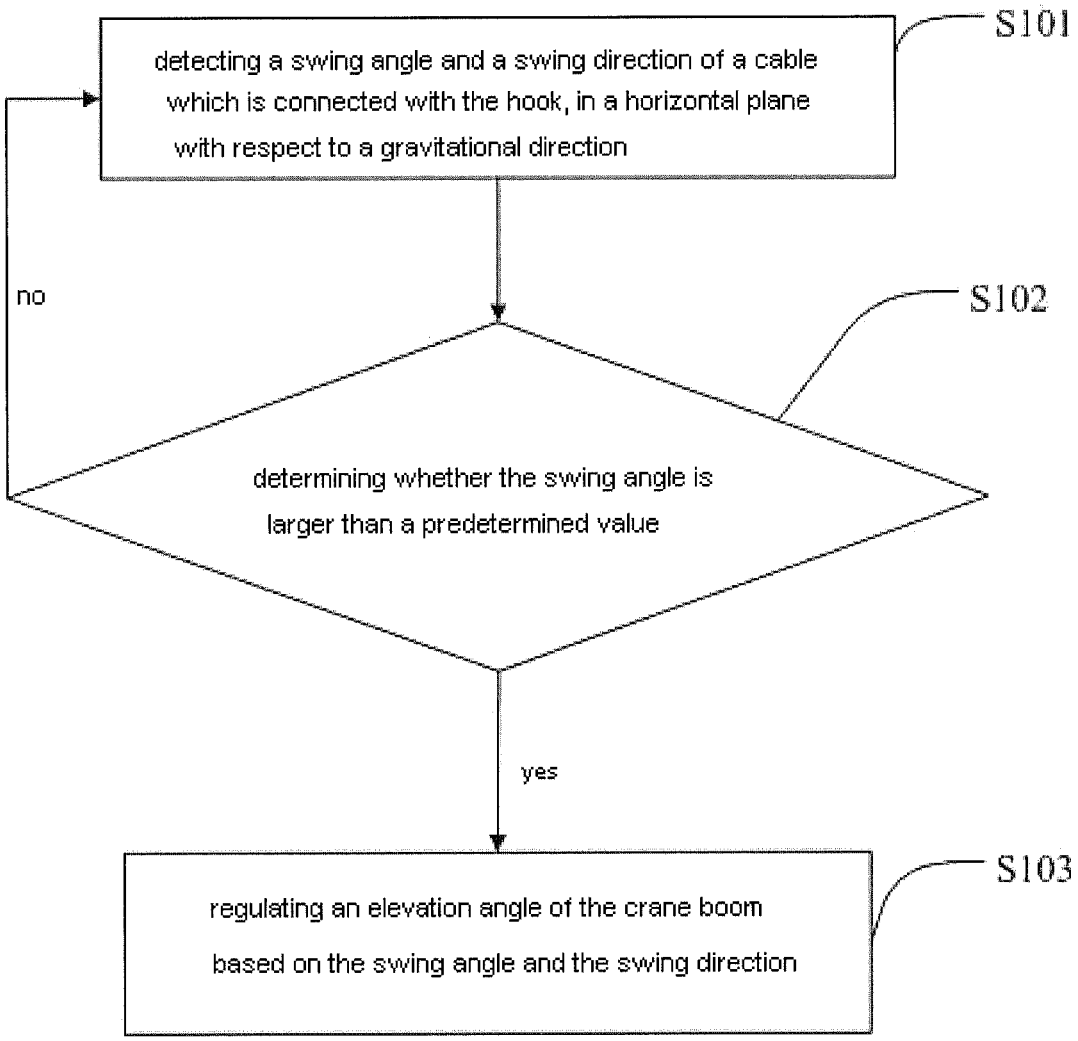
FIG. 3 is a flow chart of a specific embodiment of a method for controlling hook swing according to the present application.

Referring to FIG. 3, FIG. 3 is a flow chart of a specific embodiment of the method for controlling hook swing according to the present application.

As shown in FIG. 3, the method for controlling hook swing according to the present application includes:

Step 101, detecting a swing angle and a swing direction of a cable, which is connected with the hook, in a horizontal plane with respect to a gravitational direction.

Figure 1:
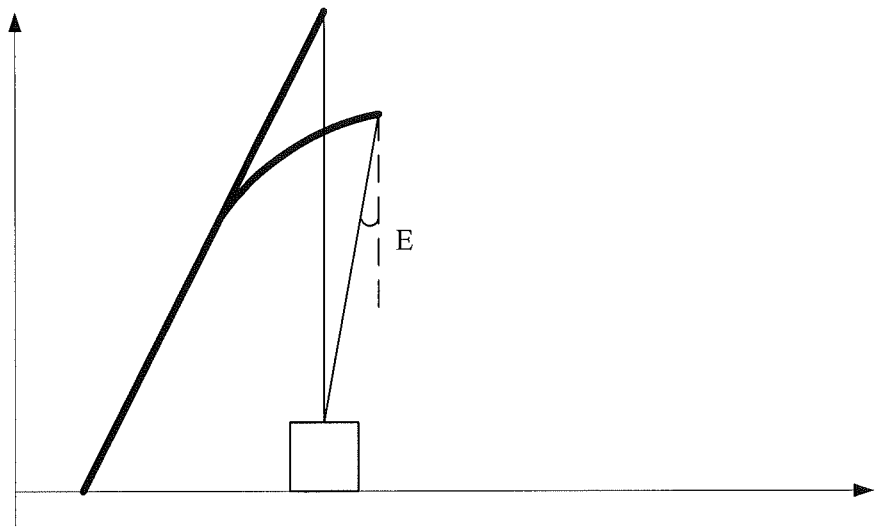
FIG. 1 is a schematic view of a hook longitudinal swing.

In some operating conditions, the hook of the telescopic boom type crane may swing in a longitudinal direction. As shown in FIG. 1, when the goods to be hoisted have a large weight or the crane boom has a large length, the crane boom may become bent during hoisting. At this time, hoist amplitude of the crane is larger than that at the beginning of the hoisting, resulting in a swing angle formed between the cable and the gravitational direction, swing direction of the cable at this time is assumed to be positive. When lowering the goods, the crane boom gradually returns to its straight state during the lowering process, which reduces a hoist radius of the crane, and thus a swing angle is formed between the cable and the gravitational direction, swing direction of the cable at this time is assumed to be negative.

Assuming that the horizontal plane which is perpendicular to the gravitational direction is a standard plane, a swing direction and a swing angle of the longitudinal swing of the cable, which is connected with the hook, in the horizontal plane, are detected.

Step 102, determining whether the swing angle is larger than a predetermined value. If the swing angle is larger than the predetermined value, the process proceeds to step 103, and if the swing angle is smaller than the predetermined value, the process proceeds to step 101.

An error threshold value $E_0$ for the swing angle is preset in advance, if the swing angle of the hook is smaller than the error threshold value $E_0$, it shows that the swing of the hook is within an error range at this time, and there is no need to regulate the swing of the hook; if the swing angle of the hook is larger than the error threshold value $E_0$, it shows the swing of the hook is beyond the allowable error range, and it is necessary perform a compensation control to the swing of the hook such that the swing of the hook falls within the error range.

The detected swing angle is compared with the preset error threshold value $E_0$ to determine whether the detected swing angle is larger than the preset error threshold value $E_0$. If the detected swing angle is larger than the preset error threshold value $E_0$, the process proceeds to step 103, and if the detected swing angle is smaller than the preset error threshold value $E_0$, the process proceeds to step 101.

Step 103, regulating an elevation angle of the crane boom based on the swing angle and the swing direction.

During hoisting of the goods, since the crane boom becomes bent during the hoisting and thus the hoist radius is increased, a positive swing angle is formed. Thereby, it needs to compensate the increase of the hoist radius by reducing the hoist radius. During lowering of the goods, since the crane boom gradually returns to its straight state during the lowering operations and thus the hoist radius is reduced, a negative swing angle is formed. Thereby, it needs to compensate the reduction of the hoist radius by increasing the hoist radius.

The elevation angle of the crane boom may be regulated based on the detected swing angle and swing direction. The elevation angle of the crane boom is increased if the detected swing direction of the hook is positive, which can reduce the hoist radius to compensate the increase of the hoist radius, and thus reduce the positive swing angle of the hook. The elevation angle of the crane boom is reduced if the detected swing direction of the hook is negative, which can increase the hoist radius to compensate the reduction of the hoist radius, and thus reduce the negative swing angle of the hook.

In a preferable technical solution, at the same time when regulating the elevation angle of the crane boom, the cable may be controlled to be loosened or tightened by controlling winding of the windlass, to compensate the hoist radius and achieve the hoisting and lowering of the goods.

The above embodiment describes the method for controlling hook swing according to the present application by taking the case in which the longitudinal swing of the hook is regulated as an example. The following embodiment will describe the method for controlling hook swing according to the present application by taking the case in which the transverse swing of the hook is regulated as an example.

Figure 4:
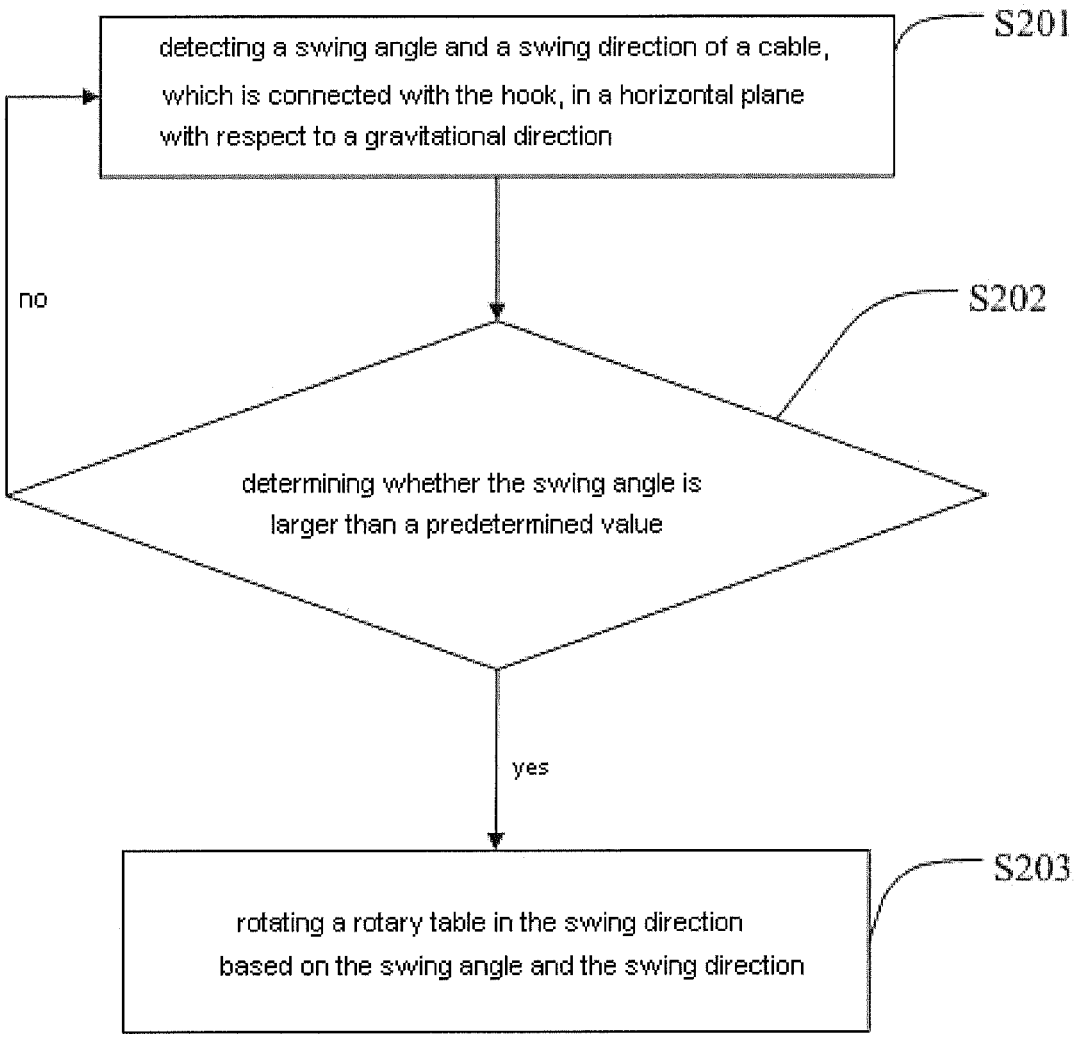
FIG. 4 is a flow chart of another specific embodiment of the method for controlling hook swing according to the present application.

Referring to FIG. 4, FIG. 4 is a flow chart of another specific embodiment of the method for controlling hook swing according to the present application.

As shown in FIG. 4, the method for controlling hook swing according to the present application includes:

Step 201, detecting a swing angle and a swing direction of a cable, which is connected with the hook, in a horizontal plane with respect to a gravitational direction.

Figure 2:
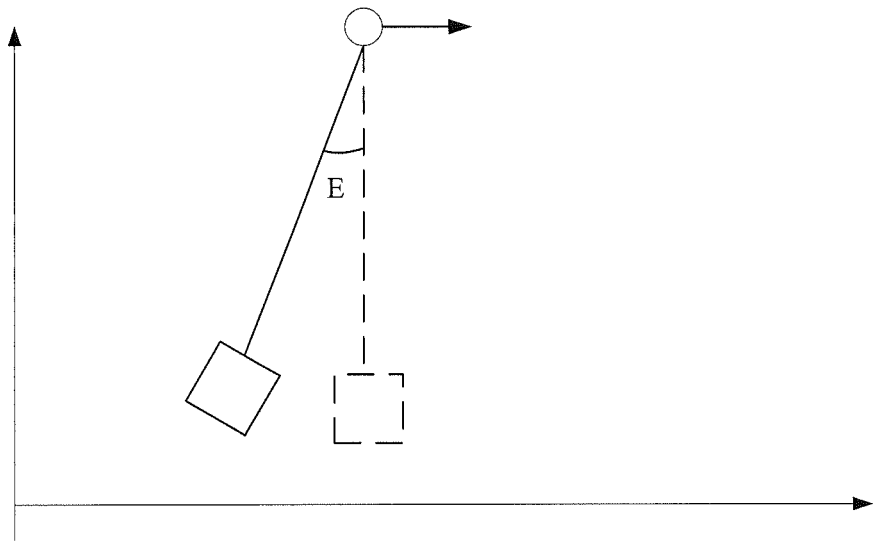
FIG. 2 is a schematic view of a hook transverse swing.

In some operating conditions, the hook of the telescopic boom type crane may swing in a transverse direction. As shown in FIG. 2, when the telescopic boom type crane is rotated, an actuation, a stop, a rotary speed and an acceleration resulted in a change of the rotary speed can cause the transverse swing of the hook having a transverse swing angle. The hook may swing in a transverse direction clockwise or counterclockwise. It is assumed that the clockwise swing of the hook is positive in the swing direction and the counterclockwise swing thereof is negative in the swing direction.

Assuming that the horizontal plane which is perpendicular to the gravitational direction is a standard plane, swing direction and a swing angle of transverse swing of the cable, which is connected with the hook, in a horizontal plane, are detected.

Step 202, determining whether the swing angle is larger than a predetermined value. If the swing angle is larger than the predetermined value, the process proceeds to step 203, and if the swing angle is smaller than the predetermined value, the process proceeds to step 201.

An error threshold value $E_0$ for the swing angle is preset in advance, if the swing angle of the hook is smaller than the error threshold value $E_0$, it shows that the swing of the hook is within an error range at this time, and there is no need to regulate the swing of the hook; if the swing angle of the hook is larger than the error threshold value $E_0$, it shows the swing of the hook is beyond the allowable error range, and it is necessary to perform a compensation control to the swing of the hook such that the swing of the hook falls within the error range.

The detected swing angle is compared with the preset error threshold value $E_0$ to determine whether the detected swing angle is larger than the preset error threshold value $E_0$ If the detected swing angle is larger than the preset error threshold value $E_0$, the process proceeds to step 203, and if the detected swing angle is smaller than the preset error threshold value $E_0$, the process proceeds to step 201.

Step 203, rotating a rotary table in the swing direction based on the swing angle and the swing direction.

When rotary action of the crane is stopped, the goods may swing in a positive or a negative direction beyond the allowable error threshold value $E_0$ for the swing angle due to moving inertia thereof.

The rotary table may be rotated in the detected swing direction based on the detected swing angle and swing direction. The rotary table is rotated in the current swing direction of the hook if the swing direction of the hook is positive, and the rotary table is also rotated in the current swing direction of the hook if the swing direction of the hook is negative, which can effectively compensate the hook swing resulting from inertia, and can bring the hook into a stable state automatically and rapidly.

In a preferable technical solution, in order to control the swing of the hook when the rotary table is actuated, stopped or accelerated, it is possible to detect a rotary speed and a rotary acceleration of the rotary table. The detected rotary speed and rotary acceleration of the rotary table may be compared with allowable standard rotary speed and rotary acceleration. If the detected rotary speed and rotary acceleration of the rotary table exceed the allowable standard rotary speed and rotary acceleration, the rotary speed and rotary acceleration of the rotary table are controlled such that the rotary speed and rotary acceleration of the rotary table are smaller than the allowable standard rotary speed and rotary acceleration, thus the rotary table can be actuated, stopped or accelerated as smoothly as possible, such that the swing angle of the hook can be stabilized.

The method for controlling hook swing according to the present application can also control a complex swing of the hook.

The hook may not swing in a single direction because of the complicated hoisting and lowering operations of the telescopic boom type crane. The swing angle of the complex swing may be divided into a longitudinal swing angle and a transverse swing angle, and controlled by the methods for controlling hook swing in the above embodiments one by one or simultaneously, such that the complex swing of the hook can be stabilized or eliminated. The controlling process will not be described in detail herein.

Hereinafter, the advantageous effects of the method for controlling hook swing according to the present application will be described.

The method for controlling hook swing according to the present application can detect the swing angle and swing direction of the hook rapidly and accurately, and can perform the compensation control to the swing angle of the hook based on the detected swing angle and swing direction, to avoid the situation that the operator subjectively regulates the swing angle of the hook according to his perception and experience, which can reduce potential safety hazard due to relying too much on human factors during the hoisting and lowering operations. With this kind of method for controlling hook swing, some hoisting and lowering operations that need high standard and high accuracy can be achieved, and safety and intelligent degree of the operations of the telescopic boom type crane itself may be enhanced.

The present application further provides a system for controlling hook swing, which will be described hereinafter with reference to the drawings.

Figure 5:
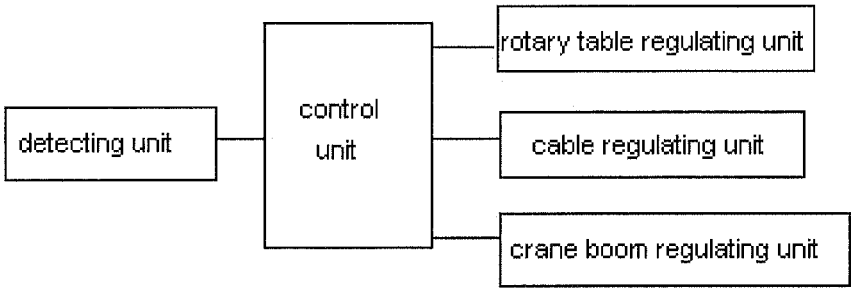
FIG. 5 is a structural framework diagram of a system for controlling hook swing according to the present application.

Referring to FIG. 5, FIG. 5 is a structural framework diagram of a system for controlling hook swing according to the present application.

As shown in FIG. 5, the system for controlling hook swing according to the present application includes:

a detecting unit, configured to detect a swing angle and a swing direction of a cable, which is connected with a hook, in a horizontal plane with respect to a gravitational direction, and to transmit a swing angle signal and a swing direction signal;

a control unit, configured to receive the swing angle signal and the swing direction signal and determine whether the swing angle is larger than a predetermined value, and to transmit a control signal if the swing angle is larger than the predetermined value;

a regulating unit, configured to receive the control signal to perform a compensation control to the swing angle of the hook.

The regulating unit may specifically include a crane boom regulating unit, a cable regulating unit and a rotary table regulating unit.

The rotary table regulating unit is configured to regulate a rotary direction and rotary speed of the rotary table. The cable regulating unit is configured to regulate tightening and loosening of the cable. The crane boom regulating unit is configured to regulate the elevation angle of the crane boom.

The detecting unit detects the swing angle and the swing direction of the cable, which is connected with the hook, in the horizontal plane with respect to the gravitational direction, and transmits a swing angle signal and a swing direction signal to a controller. The controller receives the swing angle signal and the swing direction signal and determines whether the swing angle is larger than a predetermined value, and transmits a control signal if the swing angle is larger than the predetermined value. The regulating unit receives the control signal and then performs the compensation control to the swing angle of the hook. The system for controlling hook swing according to the present application employs the methods for controlling hook swing mentioned in the above embodiments as the control strategy, which will not be described in detail.

In a preferable technical solution, the system for controlling hook swing according to the present application further includes a rotary speed measuring unit for a rotary table which is configured to measure a rotary speed of the rotary table and transmit a rotary speed signal. The control unit is further configured to receive the rotary speed signal to determine whether the measured rotary speed is larger than a predetermined rotary speed, and to control the rotary speed of the rotary table to be smaller than the predetermined rotary speed if the measured rotary speed is larger than the predetermined rotary speed.

In a preferable technical solution, the system for controlling hook swing according to the present application further includes a rotary acceleration measuring unit for the rotary table which is configured to measure a rotary acceleration of the rotary table and transmit a rotary acceleration signal. The control unit is further configured to receive the rotary acceleration signal to determine whether the measured rotary acceleration is larger than a predetermined rotary acceleration, and to control the rotary acceleration of the rotary table to be smaller than the predetermined rotary acceleration if the measured rotary acceleration is larger than the predetermined rotary acceleration.

Based on the above mentioned method for controlling hook swing and system for controlling hook swing, the present application further provides an apparatus for controlling hook swing.

Figure 6:
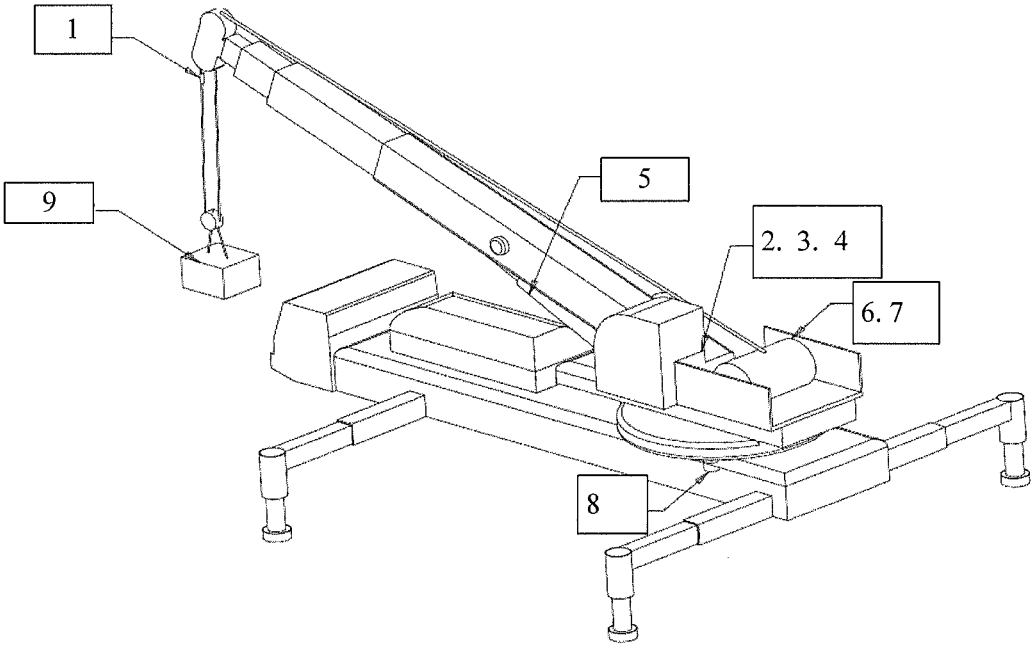
FIG. 6 is a structural schematic view of an apparatus for controlling hook swing according to the present application.

Referring to FIG. 6, FIG. 6 is a structural schematic view of an apparatus for controlling hook swing according to the present application.

As shown in FIG. 6, the apparatus for controlling hook swing according to the present application includes a swing angle detecting device for a cable 1, a controller 2, a derricking regulating valve 5 for controlling a derricking cylinder, and a rotary motor 8.

The swing angle detecting device for the cable 1 is provided on the cable at a boom head of the crane boom. A swing angle signal and swing direction signal output terminals of the swing angle detecting device for the cable 1 are connected with a swing angle signal and swing direction signal receiving terminals of the controller 2, and the control terminals of the controller 2 are connected respectively with a control terminal of the derricking regulating valve 5 and a control terminal of the rotary motor 8.

In a preferable technical solution, the apparatus for controlling hook swing according to the present application further includes a winding motor 6 configured to drive the rotary table to rotate and a winding control electromagnetic valve 7 configured to control a rotary direction and rotary speed of the winding motor 6. A control terminal of the winding control electromagnetic valve 7 is connected with the control terminal of the controller 2.

In a specific embodiment, the swing angle detecting device for a cable 1 may be a dual inclination sensor which can detect a longitudinal swing angle and a transverse swing angle of the cable simultaneously and can transmit two detecting signals simultaneously.

The operating principle of the apparatus for controlling hook swing according to the present application will be described in the following.

The swing angle detecting device for the cable 1 detects a swing angle and a swing direction of the cable, which is connected with the hook, in a horizontal plane with respect to a gravitational direction, and transmits a swing angle signal and a swing direction signal to the controller 2. The controller 2 receives the swing angle signal and the swing direction signal, and transmits a control signal to the derricking regulating valve 5 if the swing angle is a longitudinal swing angle which is larger than a predetermined value, then the derricking regulating valve 5 controls the derricking cylinder to stretch to increase an elevation angle of the crane boom if the swing direction is positive, and the derricking regulating valve 5 controls the derricking cylinder to retract to reduce the elevation angle of the crane boom if the swing direction is negative. If the swing angle is a transverse swing angle which is larger than the predetermined value, the controller 2 transmits a control signal to the rotary motor 8 which in turn drives the rotary table to rotate in the swing direction.

In a preferable technical solution, the controller 2, based on the received swing angle signal and swing direction signal, controls the winding control electromagnetic valve 7 and the winding motor 6 to control the rotary direction and rotary speed of the windlass, so as to tighten and loosen the cable.

In a preferable technical solution, the apparatus for controlling hook swing according to the present application further includes a rotary speed sensor 4 provided on the rotary table of the telescopic boom type crane. A rotary speed signal output terminal of the rotary speed sensor 4 is connected with a rotary speed signal input terminal of the controller 2. The rotary speed sensor 4 detects a rotary speed of the rotary table and transmits a rotary speed signal to the controller 2. The controller 2 receives the rotary speed signal and compares the detected rotary speed with a predetermined value, and controls the rotary motor 8 to be smaller than the predetermined value if the detected rotary speed is larger than the predetermined value.

In a preferable technical solution, the apparatus for controlling hook swing according to the present application further includes a rotary acceleration sensor 3 provided on the rotary table of the telescopic boom type crane. A rotary acceleration signal output terminal of the rotary acceleration sensor 3 is connected with a rotary acceleration signal input terminal of the controller 2. The rotary acceleration sensor 3 detects a rotary acceleration of the rotary table and transmits a rotary acceleration signal to the controller 2. The controller 2 receives the rotary acceleration signal and compares the detected rotary acceleration with a predetermined value, and controls the rotary motor 8 to be smaller than the predetermined value if the detected rotary acceleration is larger than the predetermined value.

The apparatus for controlling hook swing according to the present application is based on the above mentioned methods for controlling hook swing and system for controlling hook swing. Thus, the apparatus for controlling hook swing also has the same advantageous effects as that of the above mentioned methods for controlling hook swing and system for controlling hook swing, which will not be described in detailed herein.

The above mentioned embodiments are only preferable embodiments according to the present application. It should be noted that, an ordinary person skilled in the art can also make improvements, modifications and alterations without departing from the principle of the present application, for example, the cutting ring may be a part of corresponding tube, and may also be a separate component with a high wear resistance, and these improvements, modifications and alterations should also be deemed to fall into the protection scope of the present application.

What is claimed is:

1. A method for controlling hook swing for regulating a swing angle of a hook of a telescopic boom type crane, wherein the method for controlling hook swing comprises:

A. detecting a swing angle and a swing direction of a cable, which is connected with the hook, in a horizontal plane with respect to a gravitational direction;

B. determining whether the swing angle is larger than a predetermined value, step B proceeding to step C if the swing angle is larger than the predetermined value, and step B proceeding to step A if the swing angle is smaller than the predetermined value; and C. rotating a rotary table in the swing direction in a case that the swing angle is a transverse swing angle;

wherein the method further comprises:

detecting a rotary speed of the rotary table;

determining whether the measured rotary speed of the rotary table is larger than a predetermined rotary speed, and controlling the rotary speed of the rotary table to be smaller than the predetermined rotary speed if the measured rotary speed is larger than the predetermined rotary speed.

2. A system for controlling hook swing for regulating a swing angle of a hook of a telescopic boom type crane, wherein the system for controlling hook swing comprises:

a detecting unit, configured to detect a swing angle and a swing direction of a cable, which is connected with a hook, in a horizontal plane with respect to a gravitational direction, and to transmit a swing angle signal and a swing direction signal;

a control unit, configured to receive the swing angle signal and the swing direction signal and determine whether the swing angle is larger than a predetermined value, and to transmit a control signal if the swing angle is larger than the predetermined value;

a regulating unit, configured to receive the control signal to perform a compensation control to the swing angle of the hook; and a rotary speed measuring unit for a rotary table which is configured to measure a rotary speed of the rotary table and transmit a rotary speed signal, and wherein the control unit is further configured to receive the rotary speed signal and determine whether the measured rotary speed is larger than a predetermined rotary speed, and to control the rotary speed of the rotary table to be smaller than the predetermined rotary speed if the measured rotary speed is larger than the predetermined rotary speed.

3. The system for controlling hook swing according to claim 2, wherein the regulating unit comprises:

a rotary table regulating unit configured to regulate a rotary direction and a rotary speed of the rotary table;

a cable regulating unit configured to regulate tightening and loosening of the cable; and a crane boom regulating unit configured to regulate an elevation angle of the crane boom.

4. The system for controlling hook swing according to claim 2, further comprising a rotary acceleration measuring unit for the rotary table which is configured to measure a rotary acceleration of the rotary table and to transmit a rotary acceleration signal, and wherein the control unit is further configured to receive the rotary acceleration signal and determine whether the measured rotary acceleration is larger than a predetermined rotary acceleration, and to control the rotary acceleration of the rotary table to be smaller than the predetermined rotary acceleration if the measured rotary acceleration is larger than the predetermined rotary acceleration.

5. An apparatus for controlling hook swing for regulating a swing angle of a hook of a telescopic boom type crane, wherein the apparatus for controlling hook swing comprises a swing angle detecting device for a cable, a controller, a derricking regulating valve for controlling a derricking cylinder and a rotary motor, wherein the swing angle detecting device for a cable is provided on a cable at a boom head of a crane boom, and a swing angle signal and swing direction signal output terminals of the swing angle detecting device for a cable are connected with a swing angle signal and swing direction signal receiving terminals of the controller;

control terminals of the controller are connected respectively with a control terminal of the derricking regulating valve and a control terminal of the rotary motor; and a rotary speed sensor provided on a rotary table of the telescopic boom type crane, and wherein a rotary speed signal output terminal of the rotary speed sensor is connected with a rotary speed signal input terminal of the controller.

6. The apparatus for controlling hook swing according to claim 5, further comprising a winding motor configured to drive the rotary table to rotate and a winding control electromagnetic valve configured to control a rotary direction and a rotary speed of the winding motor, and wherein a control terminal of the winding control electromagnetic valve is connected with a control terminal of the controller.

7. The apparatus for controlling hook swing according to claim 6, wherein the swing angle detecting device for a cable is a dual inclination sensor.

8. The apparatus for controlling hook swing according to claim 5, further comprising a rotary acceleration sensor provided on the rotary table of the telescopic boom type crane, and wherein a rotary acceleration signal output terminal of the rotary acceleration sensor is connected with a rotary acceleration signal input terminal of the controller.

9. The apparatus for controlling hook swing according to claim 8, wherein the swing angle detecting device for a cable is a dual inclination sensor.

10. The apparatus for controlling hook swing according to claim 5, wherein the swing angle detecting device for a cable is a dual inclination sensor.

* * * * *